US006908256B1

(12) United States Patent
Humphries et al.

(10) Patent No.: US 6,908,256 B1
(45) Date of Patent: Jun. 21, 2005

(54) DRAINAGE GRATE ASSEMBLY

(75) Inventors: Derek Humphries, Chardon, OH (US); Roy Humpage, West Midlands (GB); Gary Edwin Mayo, Staffordshire (GB)

(73) Assignee: ACO Polymer Products, Inc., Chardon, OH (US)

( * ) Notice: Subject to any disclaimer, the term of this patent is extended or adjusted under 35 U.S.C. 154(b) by 1 day.

(21) Appl. No.: 10/874,987

(22) Filed: Jun. 23, 2004

(51) Int. Cl.[7] ..... E03F 5/06; E01C 11/22
(52) U.S. Cl. ..... 404/2; 404/4; 210/163
(58) Field of Search ..... 405/36, 43, 46, 405/50, 118, 119; 210/163, 164; 249/1, 4, 249/10–12; 404/2–4; 52/323, 576, 11

(56) References Cited

U.S. PATENT DOCUMENTS

| | | | | | |
|---|---|---|---|---|---|
| 1,426,736 | A | * | 8/1922 | Hess | 52/667 |
| 1,428,230 | A | * | 9/1922 | Hess | 52/799.13 |
| 2,031,779 | A | * | 2/1936 | Ladd | 52/668 |
| 2,084,118 | A | * | 6/1937 | Zabriskie | 52/667 |
| 2,396,735 | A | * | 3/1946 | Leigh | 52/799.14 |
| 2,917,804 | A | | 12/1959 | Barron | |
| 3,228,679 | A | | 1/1966 | Dees | |
| 4,007,566 | A | * | 2/1977 | Molitor | 52/169.7 |
| 4,337,005 | A | | 6/1982 | LeBaron | |
| 4,367,142 | A | * | 1/1983 | Blecher | 210/163 |
| 4,844,655 | A | | 7/1989 | Aleshire | |
| 4,909,660 | A | * | 3/1990 | Ferns | 404/2 |
| 4,981,395 | A | | 1/1991 | Datin et al. | |
| 5,024,550 | A | * | 6/1991 | Mainville | 404/4 |
| 5,130,016 | A | * | 7/1992 | Gavin | 210/164 |
| 5,443,327 | A | | 8/1995 | Akkala et al. | |
| 5,463,786 | A | * | 11/1995 | Mangone et al. | 14/73 |
| 5,518,339 | A | | 5/1996 | Shimizu | |
| 5,538,361 | A | | 7/1996 | Beamer | |
| 5,733,445 | A | * | 3/1998 | Fanelli | 210/164 |
| 6,349,656 | B1 | * | 2/2002 | Mitchell | 108/57.13 |
| 6,595,720 | B2 | * | 7/2003 | Humphries et al. | 405/118 |
| 6,631,588 | B1 | * | 10/2003 | Distler | 52/12 |
| 2004/0163342 | A1 | * | 8/2004 | Marks | 52/302.1 |

FOREIGN PATENT DOCUMENTS

| | | | | | |
|---|---|---|---|---|---|
| GB | 2209782 | A | * | 5/1989 | E01C 11/22 |

* cited by examiner

*Primary Examiner*—Robert E. Pezzuto
*Assistant Examiner*—Alexandra Pechhold
(74) *Attorney, Agent, or Firm*—Pearne & Gordon LLP

(57) ABSTRACT

An improved drainage grate assembly having a reinforcing assembly which is capable of providing substantially continuous support to non-apertured portions of the drainage grate. The load rating for the drainage grate assembly can be adjusted by adding metal strips to the reinforcing assembly.

11 Claims, 5 Drawing Sheets

DRAINAGE GRATE ASSEMBLY

BACKGROUND OF THE INVENTION

The present invention relates to drainage grates used in connection with trench drains and the like for the drainage of surface water. Trench drains and similar drainage structures are used in a variety of environments, such as walkways, bike and foot paths, outdoor malls, parking lots, airport tarmacs and other traffic environments which require the drainage of surface water. Trench drains and drainage structures generally are known in the art as described in, for example, U.S. Pat. Nos. 4,630,966; 4,699,544; 5,462,382 and 4,553,874, incorporated herein by reference. In order to provide access of surface water to the drainage structure, while at the same time enabling practical movement of traffic across the structure, apertured drainage grates are typically employed to provide a substantially continuous surface over which pedestrian or vehicle traffic can freely move.

Drainage grates are typically made of varying gauges of sheet metal and are, therefore, subject to damage. Dents, buckles and perforations in the drainage grate are not only aesthetically undesirable, but are also safety concerns which can lead to injury to pedestrians and damage to surface vehicles. Accordingly, drainage grates must meet particular load ratings depending upon the environment in which they are to be used. Although there is no universal system for load rating of trench drains, the internationally recognized DIN 19580 standard, incorporated herein by reference, provides a good basis on which to distinguish between classes. Basically, for trench drains under 8 inches wide, a class A rating will withstand 15 psi within the standard 3 inch by 10 inch load footprint, and is typically used in residential and light pedestrian areas. A class B rating will withstand 140 psi in the load footprint, and is typically used for sidewalks and small private parking lots. A class C rating will withstand 280 psi in the load footprint and is appropriate for commercial parking lots and the like. Classes D and above will withstand 450 psi or more in the load footprint and are found in roads or other areas experiencing heavy wheel loads.

The requirement for different load ratings typically means that a manufacturer must provide different grates for different applications. Thus, in practicality, a manufacturer must provide grates of different gauges and materials or which include various reinforcements appended thereto. However, there are practical limits to the gauges of metal which can be used and, even when various reinforcements are included, they often do not provide support to all or most of the vulnerable portions of the drainage grate surface. Thus, even a reinforced grate is still subject to damage in those regions which are not directly reinforced.

In view of the foregoing shortcomings, the present invention advantageously provides a reinforced drainage grate which is capable of providing support to all or most of the drainage grate surface, and which can provide a wide range of load ratings without having to manufacture and inventory different grates for each desired load rating.

SUMMARY OF THE INVENTION

In accordance with the invention there is provided an improved drainage grate assembly which provides improved reinforcement and enables the use of varying gauges of sheet metal where other, more durable and costly materials such as cast iron might otherwise be required. Moreover, the instant invention is advantageously capable of providing substantially continuous support and reinforcement to the entire drainage grate.

Accordingly, in one embodiment of the invention there is provided a reinforced drainage grate assembly comprising an elongate drainage grate having a substantially planar drainage surface including a plurality of apertures therethrough and a pair of longitudinally extending side portions, each side portion extending orthogonally below an underside of said drainage surface and including a bottom flange extending toward the opposing one of said side portions. The drainage grate assembly further includes a first reinforcement retaining rail disposed between a first of the bottom flanges and the underside of the drainage surface adjacent a first of said side portions, and a second reinforcement retaining rail disposed between the other of the bottom flanges and the underside of the drainage surface adjacent the opposing said side portion. Each retaining rail is an elongate member which, when assembled, comprises a back surface adjacent a side portion, a bottom surface adjacent a bottom flange, a top surface adjacent the underside of the drainage surface, and a front surface facing the opposing retaining rail. Further, each front surface includes a plurality of slots adapted to receive an end of a reinforcing strip, whereby when opposing ends of a reinforcing strip are disposed within slots in opposing retaining rails, the upper edge of the reinforcing strip abuts at least a portion of the underside of the drainage surface.

In carrying out the invention the assembly preferably includes a plurality of reinforcing strips having opposed ends disposed within the slots in the opposed retaining rails. More preferably, the slots comprise a recess disposed in the front surface and extending through said bottom surface. More preferably still, a portion of the upper surface adjacent the slots includes an aperture extending from the upper surface into the slot which is adapted to receive a portion of an upper edge of a reinforcing strip therein, whereby the portion of the upper edge abuts the underside of the drainage surface when the reinforcing strip is disposed in the slot so as to provide metal-to-metal contact therewith.

In other aspects of the invention, the assembly includes reinforcing strips having at least two different configurations. In a preferred embodiment, the assembly includes reinforcing strips that are a substantially flat strip of sheet metal and reinforcing strips that are shaped to form a substantially sinusoidal configuration when viewed on edge.

In a further aspect of the invention the assembly includes an elongate fastening member secured between the retaining rails and oriented substantially orthogonally from the underside of the drainage surface. The elongate fastening member includes an enlarged distal end portion adapted to cooperate with a receiving member in the drainage channel and secure the drainage grate assembly thereto. In a preferred embodiment, the elongate fastening member includes an upper portion adjacent the underside of the drainage surface which is secured between the retaining rails by abutment of the upper portion against upper edge portions of at least one of the reinforcing strips.

A greater understanding of these and other aspects of the invention will be had from the following detailed description and accompanying drawings.

DETAILED DESCRIPTION OF THE PREFERRED EMBODIMENTS

As seen with reference to the drawings, the preferred drainage grate assembly of the invention comprises an outer drainage grate, shown generally at 1, a pair of retaining rails 20 and a plurality of reinforcing strips 30. As discussed in more detail below, the retaining rails 20 and reinforcing strips, when assembled, cooperate to form a reinforcing assembly, shown generally at 40.

Figure 1A:
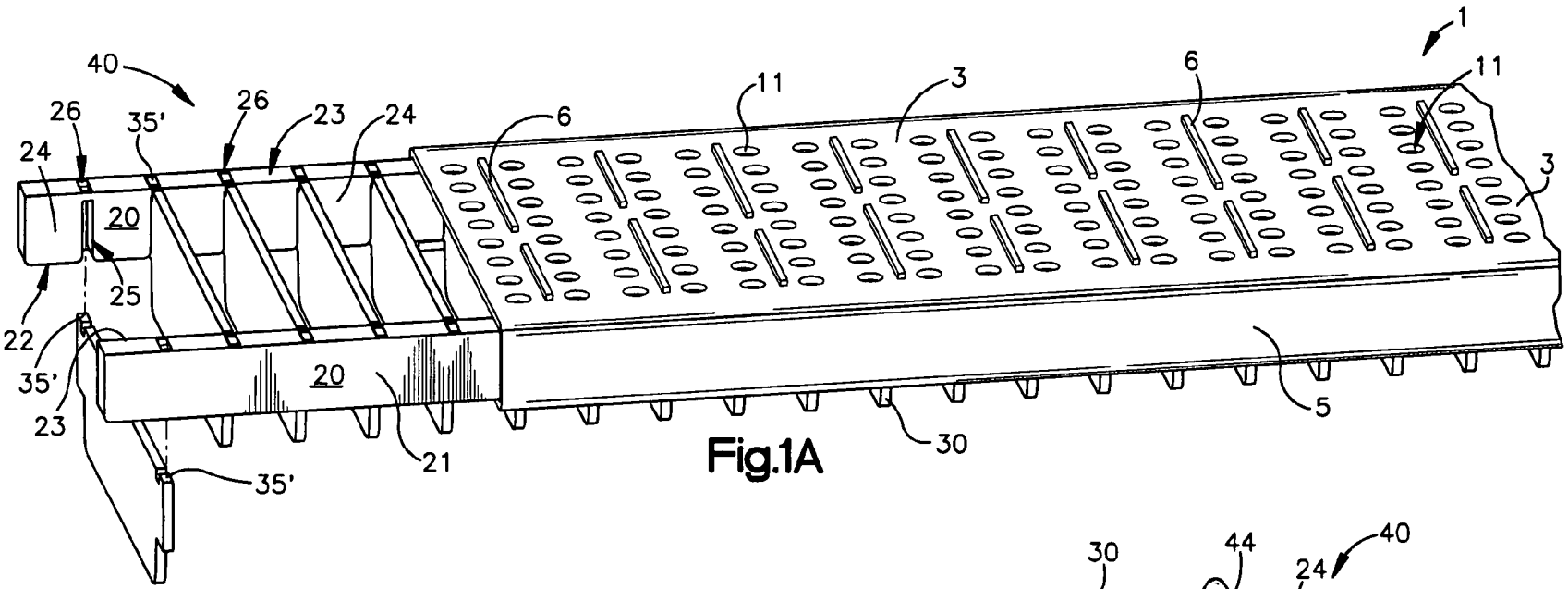
FIGS. 1A and 1B are perspective views of a drainage grate assembly according to the invention.
Figure 4A:
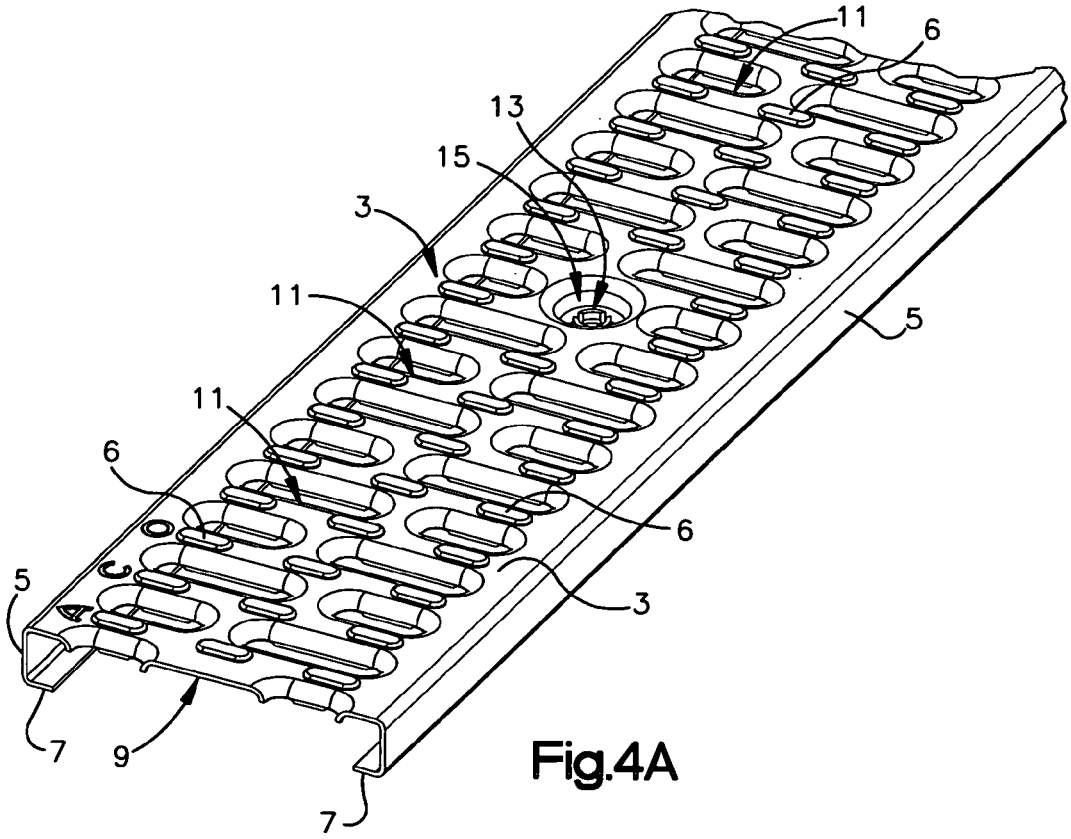
FIGS. 4A–4C are various drainage grate configurations for use in accordance with the present invention.

As seen most clearly with reference to FIGS. 1A, 1B and 4A–4C, the drainage grate 1 is formed of sheet metal having a generally planar upper drainage surface 3, and a pair of opposed side portions 5 extending orthogonally below the drainage surface 3. In each case the side portions 5 include a lower flange portion 7 extending orthogonally, preferably perpendicularly, from the side portion toward the other of said side portions 5. As shown, the flange portions 7 extend continuously along the length of said side portions 5. However, as would be apparent to those of ordinary skill in the art in view of the instant disclosure, the flange portions 7 can be discontinuous, whereby a series of flange portions 7 can be disposed along the length of side portions 5, so long as they provide support for and cooperate to retain the retaining rails 20 between said flange portions 7 and the lower surface 9 of said drainage grate. As seen in FIGS. 1A and 4A, and as would be apparent to those of ordinary skill in the art, the upper surface of drainage grates according to the invention can optionally include raised ribs or nobs 6 where improved traction is desired.

Typical metal gauges suitable for use in the manufacture of drainage grates according to the invention will be on the order of 3 millimeters or less, and more preferably 2 millimeters or less. The particular type of sheet metal used will depend upon application and aesthetic requirements, although sheet steel is generally preferred. The particular gauge used will depend upon various factors including cost and grate width, with wider grates generally requiring thicker gauges. Of course, the reinforcing strips of the present invention advantageously enable the use of thinner and hence less costly gauges. Selection of suitable materials will be within the level of ordinary skill in the art in view of the instant disclosure. Likewise, the stamping, rolling and bending processes used to fashion the drainage grates according to the invention are also well within the skill in the art. Accordingly, as will be apparent to those of ordinary skill in the art reading the instant disclosure, any standard metal shaping technique known in the art will be suitable for making and shaping the drainage grates according to the instant invention.

Figure 4B:
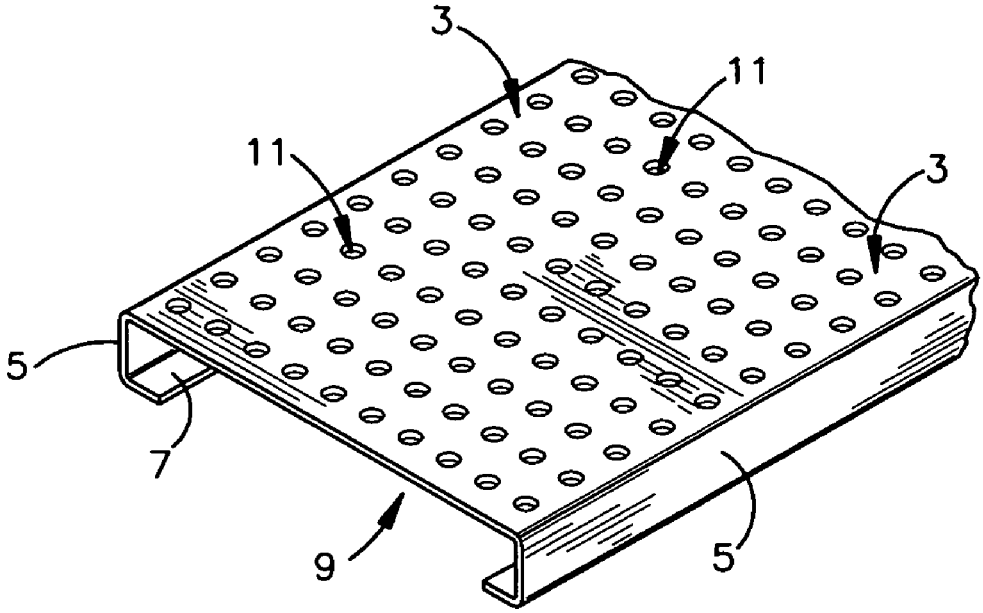
Figure 4C:
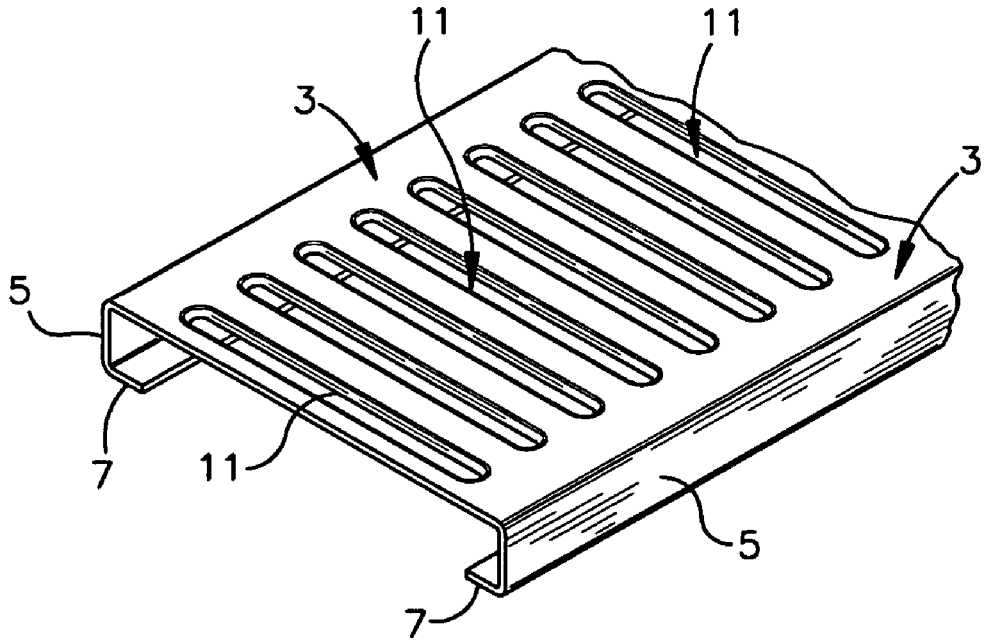

As seen in FIG. 1A and FIGS. 4A–4C, the drainage surface 3 of drainage grate 1 includes a plurality of apertures 11 for the passage of fluids from the surface of the drainage grate to the drainage structure, such as a trench drain [not shown]. The particular size, shape and pattern of apertures 11 is largely a matter of choice, so long as they function within the intended use environment to permit passage of fluids from the surface of the drainage grate. For example, in use environments where pedestrian traffic is not anticipated, but water removal requirements are high, then larger and/or more numerous apertures are needed. By contrast, in use environments where pedestrian traffic is high, smaller apertures are necessary in order to avoid potential injury associated with high heels and the like. Some preferred patterns according to the invention are shown in FIGS. 4A–4C. In preferred embodiments, the apertures 11 are arrayed in generally orthogonal, and preferably substantially perpendicular, lines with respect to the side portions 5. This maximizes the ability and simplicity with which the reinforcing strips 30, 130, 230 can provide support to the non-apertured portions of the drainage grate. Selection of any particular aperture design for any particular use environment within the scope of the instant invention will be within the level of skill in the art in view of the instant disclosure.

Figure 1B:
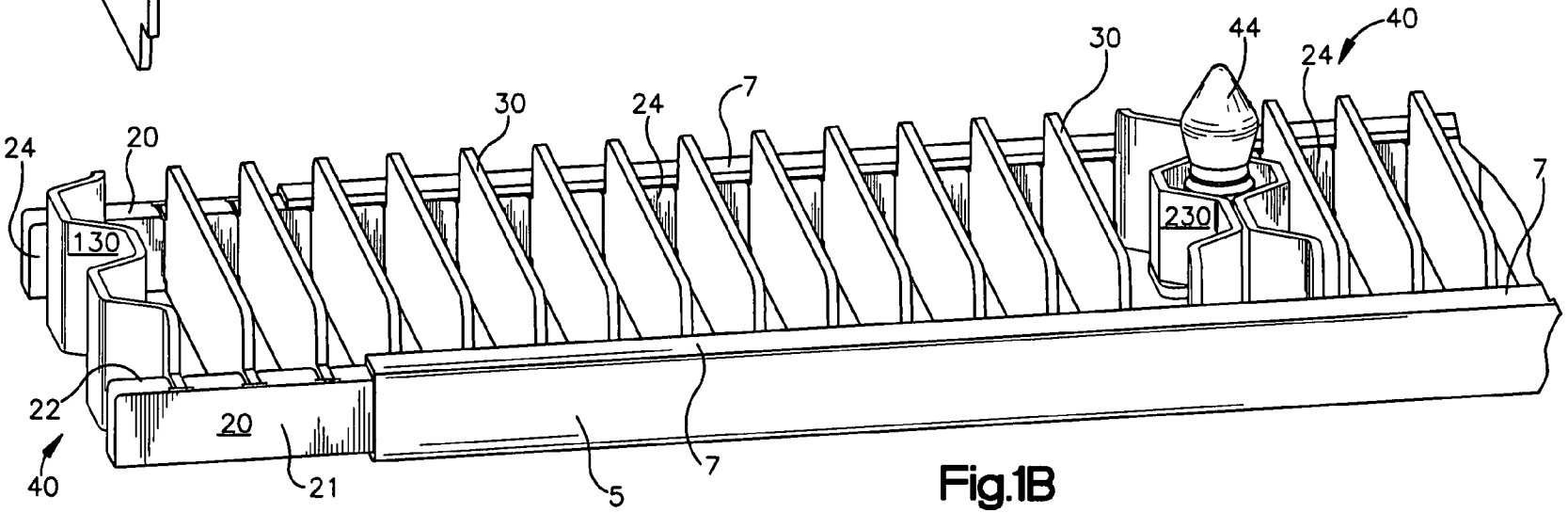
Figure 2A:
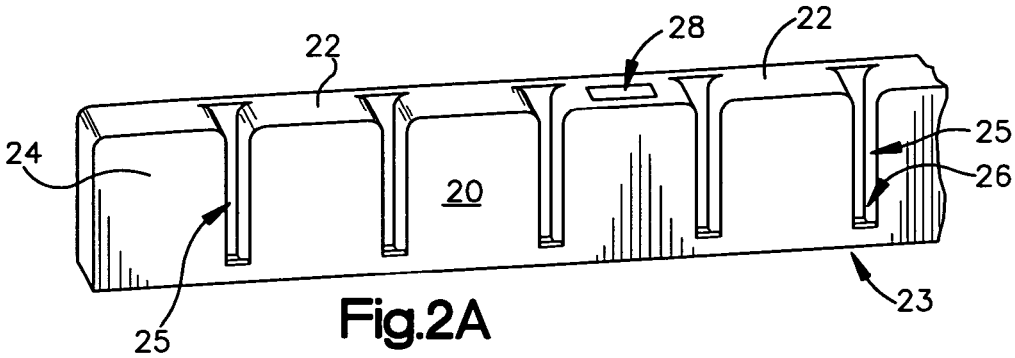
FIGS. 2A and 2B are perspective views of segments of a retaining rail for use in a reinforcing assembly according to the invention.
Figure 2B:
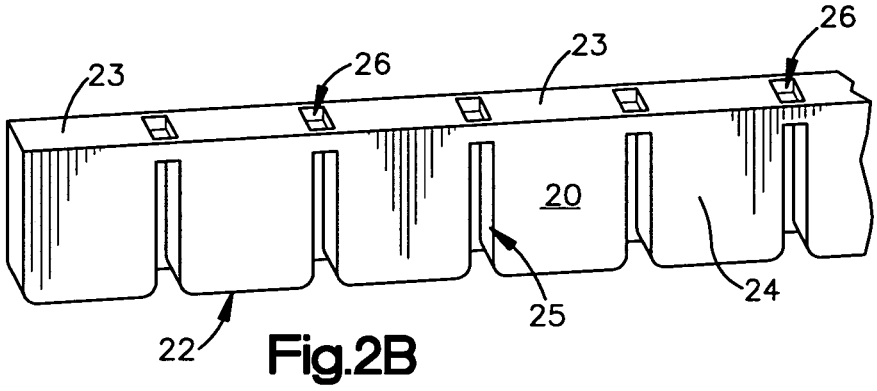

As seen best in FIGS. 1A and 1B, the drainage grate assembly of the invention further includes a reinforcing assembly 40, which comprises a pair of retaining rails 20, best seen in FIGS. 2A and 2B, and a plurality of reinforcing strips 30. As shown in FIGS. 2A and 2B, the retaining rails 20 are essentially elongate members dimensioned so as to fit between the bottom surface 9 of the drainage grate 1 and an inner surface of flange portions 7. Each retaining rail 20 has a back surface 21 which, when assembled into assembly 40, is disposed adjacent an inner surface of a side portion 5, a bottom surface 22 which is disposed adjacent an inner surface of a flange portion 7, a top surface 23 which, when assembled, is disposed adjacent the bottom surface 9 of the drainage grate, and a front surface 24 which, when assembled, faces the opposing retaining rail. It will be apparent to those of ordinary skill in the art that the use of directionally relative terms such as top and bottom herein are intended merely to refer to the relative disposition of elements in their use environment for purposes of clarity and simplicity only, and are not intended to limit the invention in this regard. Likewise, as will be apparent to those of ordinary skill in the art, the overall dimensions such as size and length of the retaining rails can vary depending upon the particular drainage grate dimensions with which it will be employed.

Each retaining rail 20 further includes a plurality of slots 25 for receiving an end portion of a reinforcing strip 30. In the preferred embodiments, the slots 25 comprise recesses or grooves disposed in the front surface 24 and extending through the bottom surface 22, best seen in FIGS. 2A and 2B. This configuration advantageously facilitates the ease with which the reinforcing strips 30 can be disposed within slots 25. Of course, the slots need not extend through the bottom surface 22 and can simply comprise recesses disposed in the front surface or instead proceed through the top surface 23. As will be apparent to those of ordinary skill in the art in view of the instant disclosure, various slot configurations or combinations of slot configurations are possible within the scope of the present invention. Moreover, the number, spacing and width of slots 25 may vary and will depend upon the desired load rating and intended use environment. As discussed in more detail below, selection of suitable slot dimensions and spacing for any particular application will be within the skill in the are in view of the instant disclosure. However, a potential advantage of the invention is that a given pair of retaining rails 20 can include enough appropriately spaced slots to provide multiple desired load ratings depending on the number and/or gauge of reinforcing strips used. Thus, it is possible with the present invention to be able to provide multiple load ratings using a single rail design, thus obviating the need to manufacture and stock a numerous different reinforcing rail designs.

In the preferred embodiment shown, the retaining rails 20 further include apertures 26 disposed in the top surface and extending into the slots 25. Apertures 26 advantageously enable the provision of enhanced support to the drainage grate surface in the region adjacent the retaining rails 20. More specifically, apertures 26 are configured to receive an upper edge portion 35' of a reinforcing strip 30 when an end portion of a reinforcing strip 30 is disposed within slot 25, thereby providing metal-to-metal contact between the upper edge surface 35' of the reinforcing strip and the bottom surface 9 of the drainage grate in the region adjacent the reinforcing rails.

The retaining rails 20 are preferably made of plastic. Suitable plastics for use in the invention will be apparent to those of ordinary skill in the art in view of the instant disclosure. Preferably, the plastic is polyvinyl chloride (PVC), high density polyethylene (HDPE) or polypropylene. The retaining rails 20 can be molded or extruded and machined using well known plastic manufacturing techniques within the level of skill in the art in view of the instant disclosure. The retaining rails 20 are preferably injection molded.

Figure 3A:
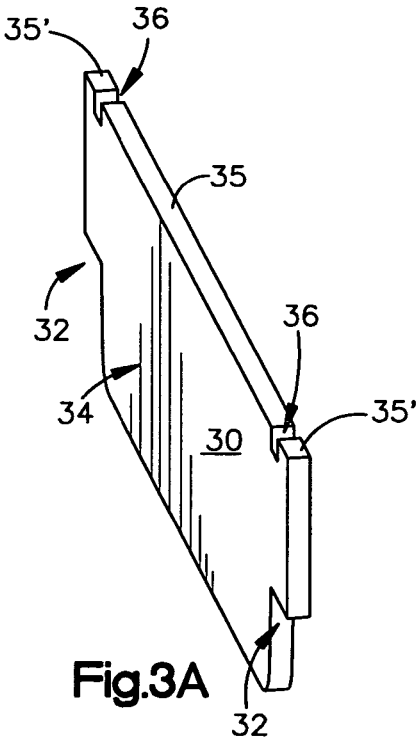
FIGS. 3A–3C are perspective views of various reinforcing strips for use in a reinforcing assembly according to the invention.

The metal reinforcing strips can be of any suitable dimension so long as they fit within slots 25 and are capable of spanning the inner diameter of the drainage grate, so that their respective end portions can be retained within the slots 25 of the respective retaining rails 20. A preferred metal strip according to the invention, shown general at 30 in FIG. 3A, is configured so as to have shoulder portions 32 which are adapted to fit within slots 25 and, in the preferred embodiments, rest on the inner surfaces of flange portions 7. As shown, the reinforcing strip 30 includes a thicker body portion 34 for providing additional support to the middle portion of the drainage surface. In each case, the opposed end portions of the reinforcing strips 30 include notches 36 which, as described above, enable upper edge portions 35' to fit within apertures 26. This preferred configuration provides a secure fit for the reinforcing strips and maximizes the amount of metal-to-metal contact between the upper edge surface 35 and the underside of the drainage surface.

Figure 3B:
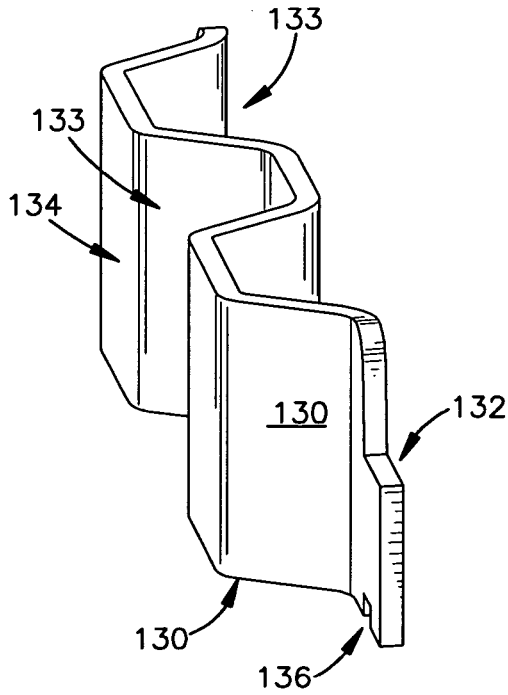

As seen in FIG. 3B, not all reinforcing strips employed in the reinforcing assembly 40 of the invention need be of the same configuration. As seen in FIG. 1A, if a standard flat reinforcing strip 30 were employed in the last pair of slots at the end of the drainage grate, a significant portion of the surface at the vary end of the grate would go unsupported, as would the corresponding region of the next adjoining grate. This unsupported region is therefore subject to damage and, because this damage could occur at the seem between two adjacent drainage grates, could be quite problematic and potentially dangerous. To remedy this potential problem, the preferred reinforcing assembly 40 includes end reinforcing strips 130. The particular configuration of the end reinforcing strips can vary and may depend in large measure on the particular nature and configuration of the apertures 11. The object, of course, is to configure the end reinforcing strip 130 to provide as much support to the very end of the drainage surface as possible, while at the same time maximizing the support to the non-apertured portions of the drainage surface inward thereof. One of ordinary skill in the art will be able to select suitable end reinforcing strip configurations for any particular aperture configuration in view of the instant disclosure.

In the preferred embodiment shown in the drawings, end reinforcing strip 130 has a generally sinusoidal configuration adapted to snake around a line of apertures so as to provide support to the drainage surface on both sides thereof. Other than being bent to include aperture accommodating regions 133, the end reinforcing strip 130 includes an upper edge surface 135 and notches 136 for providing metal-to-metal contact and support to the underside of the drainage surface 3, shoulder portions 132 for cooperating with the retaining rails, and an enlarged body portion 134 to provide enhanced support to the central region of the drainage grate, all as described above in connection with reinforcing strip 30.

In order to secure the drainage grate assembly to a trench drain, some embodiments will employ a thru-bolt extending through the drainage grate 1 and reinforcing assembly 40. Although one could simply eliminate reinforcing strips from the region of the reinforcing assembly which must accommodate the thru-bolt, this could undesirably leave portions of the drainage surface unsupported. Accordingly, additional reinforcing strip configurations may be employed to accommodate a thru-bolt or other securing mechanism. Again, the object is to configure the reinforcing strip used for this application to accommodate the thru-bolt or other securing mechanism while at the same time providing as much support to the drainage surface as possible.

Figure 3C:
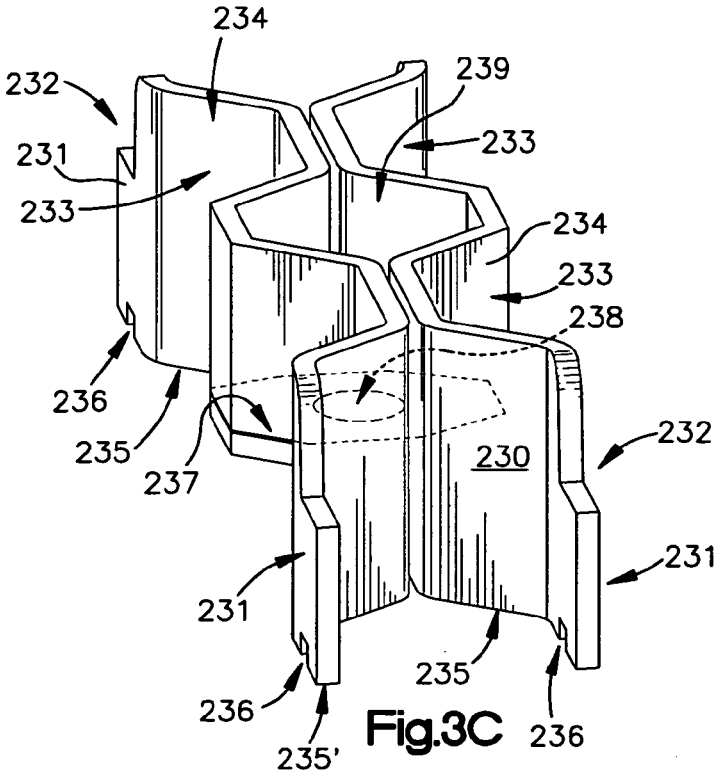

A preferred reinforcing strip 230 is shown in FIG. 3C for use in embodiments of the invention wherein either a thru-bolt or a quick-lock pin, discussed in more detail below, is used to secure the drainage grate assembly. Like reinforcing strips 30 and 130, the preferred reinforcing strip 230 includes an upper edge surface 235 and notches 236 for providing metal-to-metal contact and support to the underside of the drainage surface 3, shoulder portions 232 for cooperating with the retaining rails, and an enlarged body portion 234 to provide enhanced support to the central region of the drainage grate, all as described above in connection with reinforcing strip 30 and 130. As shown, the strip 230 is formed and shaped from sheet metal to include aperture accommodating regions 233 like those of strips 130, and a pair of opposed end portions 231 on each end to cooperate with a pair of opposed slots in each retaining rail 20. The upper edges 235 of strip 230 further include a central detent region 239 having a central planar surface 237 which includes a central aperture 238 therein. The central detent region is configured to accommodate an end portion of a quick-lock pin as described in more detail below. However, the central aperture 238 is preferably adapted to accommodate either a quick-lock pin or a thru-bolt.

More specifically, reinforcing strip 230 can be disposed in the retaining rails such that the aperture 238 will correspond to and be co-registered with a corresponding thru-bolt aperture 13 (FIG. 4A) of the drainage grate 1. In these embodiments, drainage grate 1 includes one or more apertures 13 for accommodating a thru-bolt or the like for securing the drainage grate to a trench drain or other drainage channel. Typically, the trench drain will include periodic cross members secured therein and spanning the width of the drainage channel. In such arrangements, the cross member includes a threaded aperture for receiving the thru-bolt so that when the bolt is fastened, the drainage grate is secured to the trench drain channel. Other fastening arrangements are also known in the art and suitable for use in accordance with the drainage grate assembly of the invention. As noted, the aforementioned securing strip 230 is adapted to accommodate a thru-bolt through aperture 238.

Figure 5:
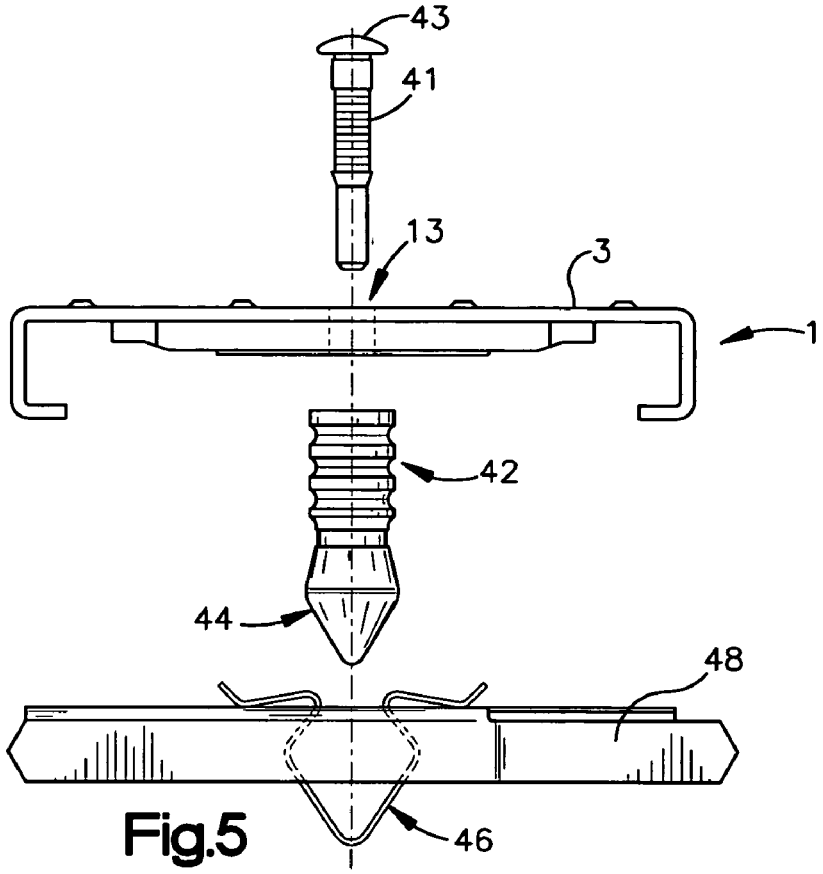
FIG. 5 is an exploded view of a fastening mechanism suitable for use in connection with a drainage grate assembly according to the invention.
Figure 6:
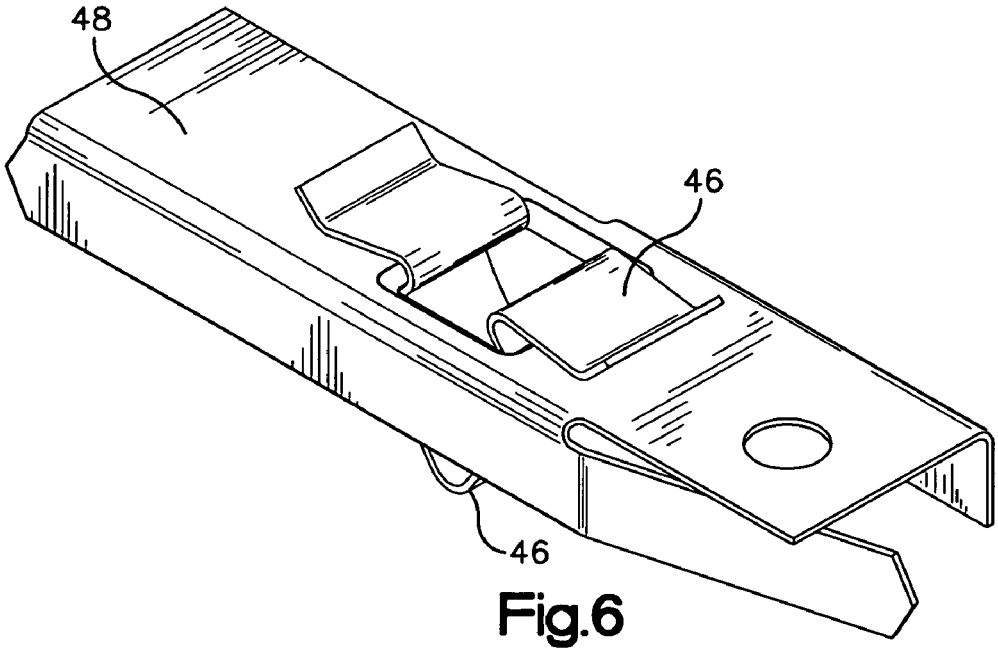
FIG. 6 is a perspective view of a portion of a fastening mechanism suitable for use in connection with a drainage grate assembly according to the invention.

A preferred means of securing the drainage grate assembly of the invention to the trench drain channel is described in European Patent No. 0605792. Briefly, as seen in connection with FIGS. 5 and 6, the drainage grate 1 includes at least one aperture 13 for receiving a thru-pin 41 rather than a thru-bolt. Associated with the thru-pin is a fastening member 42 having an enlarged end 44 for cooperating with a correspondingly shaped clamping spring 46 disposed in a cross bar 48. When the cross bar member 48 is secured within a trench drain channel so as to span the trench drain channel, the assembled drainage grate 1 can be simply snap-fit into the drainage channel by insertion of the fastening member 42 into the clamping spring 46. After elastic deformation of clamping spring 46, the fastening member 42 is secured therein, thereby securing the drainage grate 1 to the trench drain or other drainage channel.

A disadvantage of having to employ either a thru-bolt or a thru-pin is the need for the additional thru-bolt or thru-pin aperture 13 and the need to form a recess 15 (FIG. 4A) around the aperture to accommodate the head of the bolt or pin so that it sits generally flush with the remaining surface of the grate 1. In a preferred embodiment of the instant invention the through pin 41 and fastening member 42 are retained in the reinforcing assembly by the design of reinforcing strips 30, 130, 230. Accordingly, in the preferred embodiment, the modified strip 230 is employed. As discussed above, the upper edges 235 of strip 230 further include a central detent region 239 having a central planar surface 237 which includes a central aperture 238 therein. The central detent region is configured to accommodate an end portion 43 of a quick-lock pin dispose through aperture 238, onto which securing member 42 can thereafter be disposed. When opposed ends of strip 230 are disposed within corresponding slots in retaining rails 20, the end 43 of pin 41 abuts the underside 9 of the drainage surface and is retained there by central planar region 237. This enables the advantages of the snap-on connection described above in connection with FIGS. 5 and 6, without the need for apertures 13 and associated recess 15, thereby providing a safe and aesthetically desirable drainage surface with substantially continuous support.

As will be apparent to one of ordinary skill in the art in view of the instant disclosure, there are numerous configurations which will accomplish this function. For example, the base end of the securing member 42 and/or pin 41 can comprise or be secured to a generally rectangular block or an enlarged flange which is held in place by the upper edges 35 of the substantially flat reinforcing strips 30 being modified to fit around the base end of the member 42 or pin 41. However, such configurations have the disadvantage of not having any reinforcing strip surfaces in abutment with the underside of the drainage surface on either side of the securing member between the member and the rails. Thus, for example, one could employ two end reinforcing strips 130 adjacent one another and arranged such that aperture accommodating regions 135 accommodate a thru-bolt disposed therebetween. One of ordinary skill in the art will be able to select suitable reinforcing strip configurations for any particular aperture configuration in view of the instant disclosure.

In a preferred embodiment, the reinforcing rails 20 and the desired number and gauge of reinforcing strips 30, 130, 230 are assembled to form reinforcement assembly 40 separately from the drainage grate 1, which is likewise formed and shaped separately. The reinforcing assembly 40 is thereafter inserted longitudinally into the drainage grate 1 and secured in place. Alternatively, the drainage grate 1 can be formed and then shaped around the assembled reinforcing assembly 40, whereafter the reinforcing assembly 40 is secured in place within the drainage grate 1. The reinforcing assembly can be secured within the drainage grate by any means which does not interfere with its ability to properly seat within a drainage channel. Suitable means can include mechanical fasteners or the provision of additional flange portions at opposite ends of the grate 1 which can be bent over, or otherwise cooperate with the opposed end strips 130 of the reinforcing assembly 40 to secure the assembly in place. In the preferred embodiment, the retaining rails 20 includes one or more detents 28, in their bottom surfaces 22 adjacent the flange portions 7, whereby the reinforcing member is secured within drainage grate 1 by a simple crimping or stamping action on the portion of the flanges 7 adjacent the detents 28.

As will be apparent to those of ordinary skill in the art, depending upon the number and/or gauge of the metal reinforcing strips present in slots 25, the reinforcing strength of reinforcing assembly 40, and hence the load rating of the drainage grate 1 will vary. As a general rule, the thicker the gauge and/or the larger the number of metal strips, the higher the load rating will be. Typical gauges for strips used in accordance with the invention will generally be two millimeters or less. Where it is desired to stock thinner gauge strips, multi-tiered slots may be employed which can securely accommodate a single strip or multiple strips disposed side-by-side within a single slot 25 to achieve the desired effect. In carrying out the invention, one can theoretically obtain load ratings ranging from Class A to Class D or E using the reinforcing assembly 40 of the invention, although other means of reinforcement and or different materials will generally be used to obtain ratings above Class C. However, as load ratings and test methods may vary throughout the world, those of ordinary skill in the art will recognize that the invention does not lie in the ability to achieve any particular standard or specific test specification. Rather, the invention lies in the provision of a reinforcing member which provides a means by which one of ordinary skill in the art can tailor the support provided to any particular drainage grate to any desired load requirements and obtain substantially continuous support.

In the preferred embodiments according to the invention, best seen in FIGS. 1A and 1B, an upper edge of a reinforcing strip is disposed adjacent the underside of the drainage surface between virtually every interval between the rows of apertures, thereby providing substantially continuous support to the drainage grate. Desired load ratings of Class B and Class C can readily be achieved by simply adding metal strips 30 and/or increasing the gauge of the metal strips being employed. In carrying out this aspect of the invention, one can readily approximate the number and/or gauge of metal strips required to obtain the necessary load rating by calculating the I-value for a simply supported beam as is known to those of ordinary skill in the art. However, in practicality, altering the load rating of any particular drainage grate assembly according to the invention is determined empirically by introducing the desired number of metal strips and testing the load rating using a suitable load footprint. This is particularly important because, as noted above, the invention is not limited to the ability to meet any particular rating, test or standard, but can instead be tailored to the needs of any particular situation. In the preferred embodiment, the load rating is empirically tested using a 3 inch by 10 inch load footprint according to DIN 19580 for grates up to 8 inches wide, a 6 inch by 10 inch footprint for grates between 8 and 12 inches wide, and a 10 inch wide footprint for grates in excess of 12 inches, although other suitable methods will be apparent to those of ordinary skill in the art in view of the instant disclosure.

Modifications and variations of the invention will be apparent to those skilled in the art in the light of the foregoing detailed disclosure and drawings. Therefore, it is to be understood that, with the scope of the appended claims, the invention can be practiced otherwise than shown and described.

What is claimed is:

1. A drainage grate assembly comprising:

a) an elongate drainage grate having a substantially planar drainage surface including a plurality of apertures therethrough and a pair of longitudinally extending side portions, each side portion extending orthogonally below an underside of said drainage surface and including a bottom flange extending toward the opposing one of said side portions;

b) a first reinforcement retaining rail disposed between a first of said bottom flanges and said underside of said drainage surface adjacent a first of said side portions, and a second reinforcement retaining rail disposed between the other of said bottom flanges and said underside of said drainage surface adjacent the opposing said side portion;

c) each said retaining rail being an elongate member comprising a back surface adjacent a side portion, a bottom surface adjacent a bottom flange, a top surface adjacent said underside of said drainage surface, and a front surface facing an opposing said retaining rail; each said front surface including a plurality of slots adapted to receive an end of a reinforcing strip; whereby when opposing ends of a reinforcing strip are disposed within slots in opposing retaining rails, an upper edge of said reinforcing strip abuts at least a portion of said underside of said drainage surface.

2. The assembly according to claim 1 including a plurality of reinforcing strips having opposed ends disposed within slots in said opposed retaining rails.

3. The assembly according to claim 1 wherein at least one said slot comprises a recess disposed in said front surface and extending through said bottom surface.

4. The assembly according to claim 1 wherein a plurality of said slots comprise recesses disposed in said front surface and extending through said bottom surface.

5. The assembly according to claim 1 wherein a portion of said upper surface adjacent at least one said slot includes an aperture extending from said upper surface into said slot, and adapted to receive a portion of an upper edge of a reinforcing strip therein, whereby said portion of said upper edge abuts said underside of said drainage surface when said reinforcing strip is disposed in said slot.

6. The assembly according to claim 3 wherein a portion of said upper surface adjacent said at least one said slot includes an aperture extending from said upper surface into said slot, and adapted to receive a portion of an upper edge of a reinforcing strip therein, whereby said portion of said upper edge abuts said underside of said drainage surface when said reinforcing strip is disposed in said slot.

7. The assembly according to claim 2 wherein portions of said upper surfaces of said retaining rails adjacent a plurality of said slots include apertures extending from said upper surface into said slot, and wherein portions of said upper edges of said reinforcing strips are disposed within said apertures so that said portions of said upper edges abut said underside of said drainage surface through said apertures.

8. The assembly according to claim 2 comprising reinforcing strips having at least two different configurations.

9. The assembly according to claim 8 wherein in one said configuration said reinforcing strip comprises a substantially flat strip of sheet metal and in another said configuration said reinforcing strip comprises a strip of sheet metal shaped to form a substantially sinusoidal configuration when viewed on edge.

10. The assembly according to claim 1 further including an elongate fastening member secured between said retaining rails and oriented substantially orthogonally from said underside of said drainage surface, said elongate fastening member including an enlarged distal end portion.

11. The assembly according to claim 10 wherein said elongate fastening member includes an upper portion adjacent said underside of said drainage surface and is secured between said retaining rails by abutment of said upper portion against upper edge portions of at least one said reinforcing strip.

* * * * *